United States Patent [19]

Draper et al.

[11] Patent Number: 4,637,346

[45] Date of Patent: Jan. 20, 1987

[54] COMPACT MODEL STEAM GENERATOR HAVING MULTIPLE PRIMARIES

[75] Inventors: Robert Draper, Churchill Boro; Donald G. Lorentz, Irwin; Allen J. Baum, Pittsburgh; George Economy, Murrysville, all of Pa.

[73] Assignee: Westinghouse Electric Corp., Pittsburgh, Pa.

[21] Appl. No.: 724,368

[22] Filed: Apr. 17, 1985

[51] Int. Cl.[4] ..... F22B 1/00

[52] U.S. Cl. ..... 122/4 A; 73/865.6; 122/504

[58] Field of Search ..... 122/4 R, 4 A, 379, 402, 122/403, 504; 73/432 SD; 376/245

[56] References Cited

U.S. PATENT DOCUMENTS 4,135,552 1/1979 Mendolia ..... 165/104.32
4,377,737 3/1983 Berry ..... 122/4 A X

OTHER PUBLICATIONS

"Evaluation of Surrogate Boilers for Steam Generators", by M. J. Bell, W. R. Kassen, L. A. Smith and S. G. Sawochka (published Mar. 1983).

Document entitled "Evaluation of Environmental Effects on IGA of Alloy 600", by W. M. Connor, D. Smith-Magowan and G. Economy, presented at EPRI Contractors Meeting on IGA, held between Nov. 30 and Dec. 2, 1983, Clearwater Beach, Fla. (cf. FIG. 1).

Document entitled "Task 300—IGA Testing in Superheat Devices", by G. Economy, W. M. Connor and R. G. Aspden, presented at Contractors Meeting at EPRI offices, Palo Alto, Calif., Nov. 12-14, 1984 (cf. FIG. 3-1).

*Primary Examiner*—Edward G. Favors
*Attorney, Agent, or Firm*—L. A. DePaul

[57] ABSTRACT

An improved, compact model steam generator having multiple primary systems is described herein. The model steam generator of the invention is capable of simultaneously simulating a plurality of thermo-hydraulic conditions which may exist in various areas of a full-scale nuclear steam generator in order that the effect of these various conditions on the heat exchange tubes within the full-scale generator may be separately monitored. The model steam generator of the invention generally includes a boiler vessel having a primary side which houses a plurality of individually controllable primary systems, a tubesheet, a secondary side, and a plurality of sample heat exchange tubes for transferring heat between each of the individual primary systems and the secondary side of the boiler vessel. A heat flux control system connected to each of the heat sources within the primary systems allows the operator to separately adjust the heat fluxes of each of the ends of the sample tubes disposed within the secondary side of the boiler vessel. In order to reduce the longitudinal and diametrical dimensions of the primary side of the boiler vessel, the heat source used in each of the individual primary systems is preferably a single, high-intensity electrical heater formed from a coil or other high density configuration of electrical resistance wire. Moreover, each of these primary systems may be housed within the tube-receiving bores of the tube sheet of the boiler vessel in order to minimize the longitudinal dimensions of the primary side even further.

34 Claims, 9 Drawing Figures

COMPACT MODEL STEAM GENERATOR HAVING MULTIPLE PRIMARIES

BACKGROUND OF THE INVENTION

1. Field of the Invention

This invention relates to an improved compact model steam generator which has the ability to accurately simulate a variety of separate thermo-hydraulic conditions within a full-scale steam generator in order to separately monitor the corrosion effects of these conditions on the heat exchange tubes within the full-scale steam generator.

2. Description of the Prior Art

Model steam generators for monitoring the amount of corrosion degradation occurring within the heat exchange tubes of nuclear steam generators are known in the prior art. Generally speaking, such model generators operate by subjecting an array of sample heat exchange tubes to the same set of heat, pressure and chemical conditions which surround the heat exchange tubes in such nuclear steam generators. If these conditions are accurately simulated, the amount and nature of corrosion which occurs in the sample tubes of the model steam generator will provide an accurate indication of the tube corrosion present in the nuclear steam generator being monitored. Such model steam generators are a particularly useful form of corrosion monitor because they obviate (or at least reduce) the need for shutting down a nuclear plant and sending technicians into the radioactive interiors of the generators.

However, such model steam generators are useful only insofar as they are capable of accurately simulating at least one set of the heat, pressure and chemical conditions which actually exist within a selected portion of the nuclear steam generator. Any material departures from these conditions will adversely affect the ability of the model steam generator to accurately monitor the amount of corrosion accumulating around the heat exchange tubes and support plates within the full scale steam generator. In order to understand the difficulties in building a practical model steam generator which provides an accurate monitor for such tube corrosion, one must first understand how nuclear steam generators are generally constructed, and what chemical, thermal and hydraulic conditions are responsible for the tube corrosion.

Nuclear steam generators are comprised of three principal parts, including a primary side, a secondary side, and a tubesheet in which the inlet and outlet ends of a plurality of U-shaped tubes are mounted. The tubesheet and U-shaped tubes define a pressure boundary between the primary and secondary sides. The primary side of the generator defines a first hydraulic flowpath through the inlets, outlets and interior surfaces of the U-shaped tubes, and includes a divider sheet which hydraulically isolates the inlet ends of the U-shaped tubes from the outlet ends. The secondary side includes a feedwater inlet, and defines a second hydraulic flowpath around the outside surfaces of these tubes. Hot radioactive water flowing out of the nuclear reactor core is admitted into the section of the primary side containing all of the inlet ends at the U-shaped tubes. This hot water flows into these inlets, up through the tubesheet, and circulates around the U-shaped tubes which extend within the secondary side of the steam generator. The heated water transfers its heat through the walls of the U-shaped tubes to non-radioactive feedwater and recirculating water flowing through the secondary side of the generator, thereby converting it to non-radioactive steam. After the nuclear-heated water circulates completely around the U-shaped tubes, it flows back through the tubesheet, through the outlets of the U-shaped tubes, and into the outlet section of the primary side, where it is recirculated back into the core of the nuclear reactor. The inlet ends of the U-shaped tubes are known as the "hot legs" and the outlet ends of these tubes are known as the "cold legs". An illustration of this general arrangement is present in FIG. 1 of U.S. patent application Ser. No. 567,328, filed Dec. 30, 1983 and assigned to Westinghouse Electric Corporation, the entire specification of which is hereby expressly incorporated herein by reference.

Over a period of time, the heat exchange tubes of such nuclear steam generators can suffer a number of different types of corrosion degradation, including denting, stress corrosion cracking, intergranular attack, and pitting. In situ examination of the tubes within these generators has revealed that most of this corrosion degradation occurs in what are known as the crevice regions of the generator. Such crevice regions include the annular space between the heat exchange tubes and the tubesheet, as well as the annular clearance between these tubes and the various support plates in the secondary side which are used to uniformly space and align these tubes. It is believed that the corrosion which occurs in these crevice regions is caused from the corrosive chemicals in the sludge which accumulates in these regions. Deposits of sludge tend to collect in these crevices from the effects of gravity. Additionally, the relatively poor hydraulic circulation of the water in these regions tends both the create and to maintain the sludge in these crevices, as well as to create localized areas of elevated temperature (or "hot spots") in the tubes adjacent the sludge. These "hot spots" create local concentrations of corrosive impurities and act as a powerful catalyst in causing the exterior surface of the heat exchange tubes to react with the corrosive chemicals and the sludge. The resulting corrosion products tend to fill the crevices even more, thereby exacerbating the corrosion-producing conditions. While most nuclear steam generators can be sludge-lanced to periodically sweep the sludge out of the generator vessel, the sludges in the crevice regions are not easily swept away by the hydraulic currents produced by such systems. Despite the fact that the heat exchange tubes of such nuclear generators are typically formed from corrosion-resistant Inconel® 600 alloy, the combination of the localized regions of heat and corrosive sludges can ultimately cause the heat exchange tubes to crack, and leak radioactive water from the primary side into the non-radioactive water in the secondary side of the generator. However, such dangerous leakage need not occur if the heat exchange tubes are subjected to remedial action (such as plugging or sleeving) before corrosion causes cracks in the walls.

Model steam generators were developed in order to accurately monitor the amount of corrosion degradation occurring in the heat exchange tubes of a particular nuclear steam generator so that corrective actions may be taken before any of the tube walls crack. Such model steam generators have been found to be a particularly accurate way of ascertaining the amount of corrosion degradation occurring in the heat exchange tubes of a nuclear steam generator, because the particular amount of corrosion which the feedwater chemistry and thermohydraulics in a particular region of a given generator will induce in a particular set of tubes is virtually impossible to predict by purely theoretical models.

Unfortunately, prior art model steam generators are not without significant shortcomings. For example, none of these prior art model steam generators includes more than one primary system. Accordingly, if the plant operator wishes to simultaneously monitor the corrosion effects on heat exchange tubes in different regions of the full-scale generator, he must purchase and install two separate model steam generators if he is to obtain the information he desires. Another shortcoming associated with such prior art model steam generators is their relatively large size and weight, which makes them unwieldy not only with respect to installation, but to disassembly and reassembly after the completion of each monitoring test. One type of model steam generator which solves much of the size and weight problems by means of a simple and relatively inexpensive design is described and claimed in U.S. application Ser. Nos. 636,437, 636,438, 636,449 and 636,450, all of which were filed on July 31, 1984 and assigned to the Westinghouse Electric Corporation. However, this particular design of model steam generator still does not have the capacity to simultaneously simulate two or more sets of thermo-hydraulic conditions which may exist within the full-scale steam generator being monitored. Accordingly, a power plant operator wishing to simultaneously monitor the tube corrosion in both "hot leg" and "cold leg" portions of the full-scale generator would have to purchase, install and operate two of these types of model steam generators. Clearly, there is a need for a model steam generator which is capable of simultaneously simulating two or more sets of thermo-hydraulic conditions in order that the amount of tube corrosion occurring in different regions within the full-scale generator may be monitored. Ideally, such a model generator should also be relatively compact in size so that it could easily fit into areas of constricted space, and lightweight so that it could be easily installed on the feedwater system of the full-scale generator being monitored. Finally, it would be desirable if it were also easily dissembled and reassembled in order that the operators of the model generator might conduct their corrosion-monitoring tests with a minimum of awkward and time-consuming handling.

SUMMARY OF THE INVENTION

In its broadest sense, the invention is an improved model steam generator having multiple primary systems for simultaneously simulating one or more sets of thermo-hydraulic conditions within a full-scale steam generator in order to monitor the effects of these conditions on the heat exchange tubes at various locations within the full-scale generator. The invention generally comprises a boiler vessel having a primary side, a tubesheet, and a secondary side, a plurality of sample heat exchange tubes for conducting heat from the primary systems within the primary side to the secondary side of the boiler vessel, and a control means for separately controlling the heat flux by individually controlling the heat sources within each of the primary systems. Each of the primary systems is preferably individually pressure-sealed in order that the pressure differential between the inside of each of the sample tubes and the secondary side of the boiler may be separately controlled. This feature is particularly useful when one or more of the sample tubes develops a crack from either corrosion or denting in the secondary side of the boiler, because the loss of the pressure seal between one of the primary systems of the model steam generator does not necessitate a cessation of the test being carried out in the remaining sample tubes.

Each of the primary systems may include an elongated chamber for holding a reservoir of water, an electric heater for converting the water in the reservoir to steam, and a riser tube concentrically disposed within the sample tube for providing a thermosyphonic circulation between the steam generated by the electric heater and the resulting condensate which flows down the inside walls of the sample tube. In order to minimize the length of the primary side of the improved model steam generator, the electrical heater may include a high-density configuration of electrical resistance wire, such as a coil, in order to shorten the length of the longitudinal chamber used in each primary system. In order to render the primary side of the boiler vessel diametrically compact, the cross-sectional area of the longitudinal chambers of each of the primary systems is preferaby no more than about four times the cross-sectional area of its associated sample tube. In order to compact the longitudinal dimensions of the primary side even further, each of the primary systems may be housed within the tubesheet of the boiler vessel. More specifically, the longitudinal chambers of each of the primary systems may be formed from the tube-housing bores which normally exist in the tubesheet. Finally, in order to minimize the number of hydraulic components associated with each of the individual primary systems in the primary side of the boiler vessel, each of these primary systems may be charged by a single charging pump by way of a hydraulic manifold.

BRIEF DESCRIPTION OF THE SEVERAL FIGURES

DETAILED DESCRIPTION OF THE PREFERRED EMBODIMENTS

General Overview of the Structure and Operation of the Invention

Figure 1:
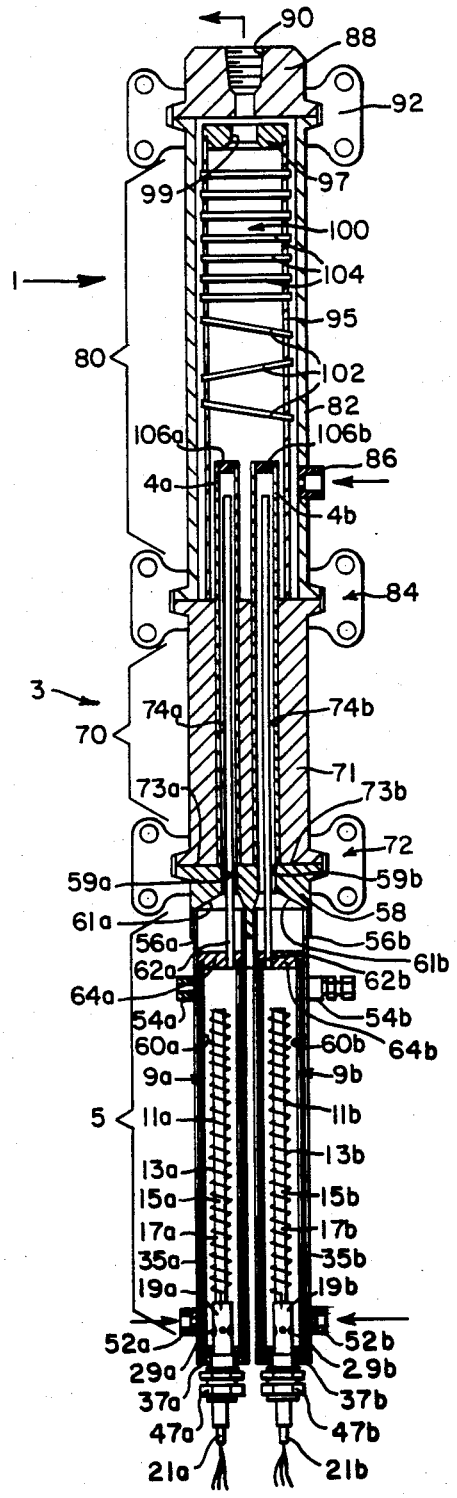
FIG. 1 is a cross-sectional side view of a first preferred embodiment of the model steam generator of the invention.

With reference now to FIG. 1, wherein like components are designated with like numerals throughout all of the several figures, the first preferred embodiment of the improved, compact model steam generator 1 of the invention generally comprises a boiler vessel 3 having a primary side 5, a sample tubesheet 70, and a secondary side 80. The boiler vessel 3 houses four sample heat exchange tubes 4*a*, 4*b*, 4*c* and 4*d* for transferring heat from the primary side 5 of the vessel 3, through the sample tubesheet 70, and ultimately to the secondary side 80. The heat released from the sample tubes 4*a*, 4*b*, 4*c* and 4*d* is used to generate steam from feedwater which is introduced into the secondary side 80 through feedwater inlet port 86. As will be discussed in more detail hereinafter, the bottom end of each of the sample heat exchange tubes 4*a*, 4*b*, 4*c* and 4*d* is thermally coupled to separately controllable primary systems 9*a*, 9*b*, 9*c* and 9*d* in the form of independent thermosyphon boiler cells. Because the thermal output of each of the primary systems 9*a*, 9*b*, 9*c* and 9*d* is separately controllable, both the heat flux and the surface temperature of the upper portions of the sample tubes 4*a*, 4*b*, 4*c* and 4*d* which extend into the secondary side 80 may be separately controlled to simultaneously simulate the different thermo-hydraulic conditions present within different sections of the full-scale generator being monitored, such as "hot leg" or "cold leg" conditions.

Figure 4:
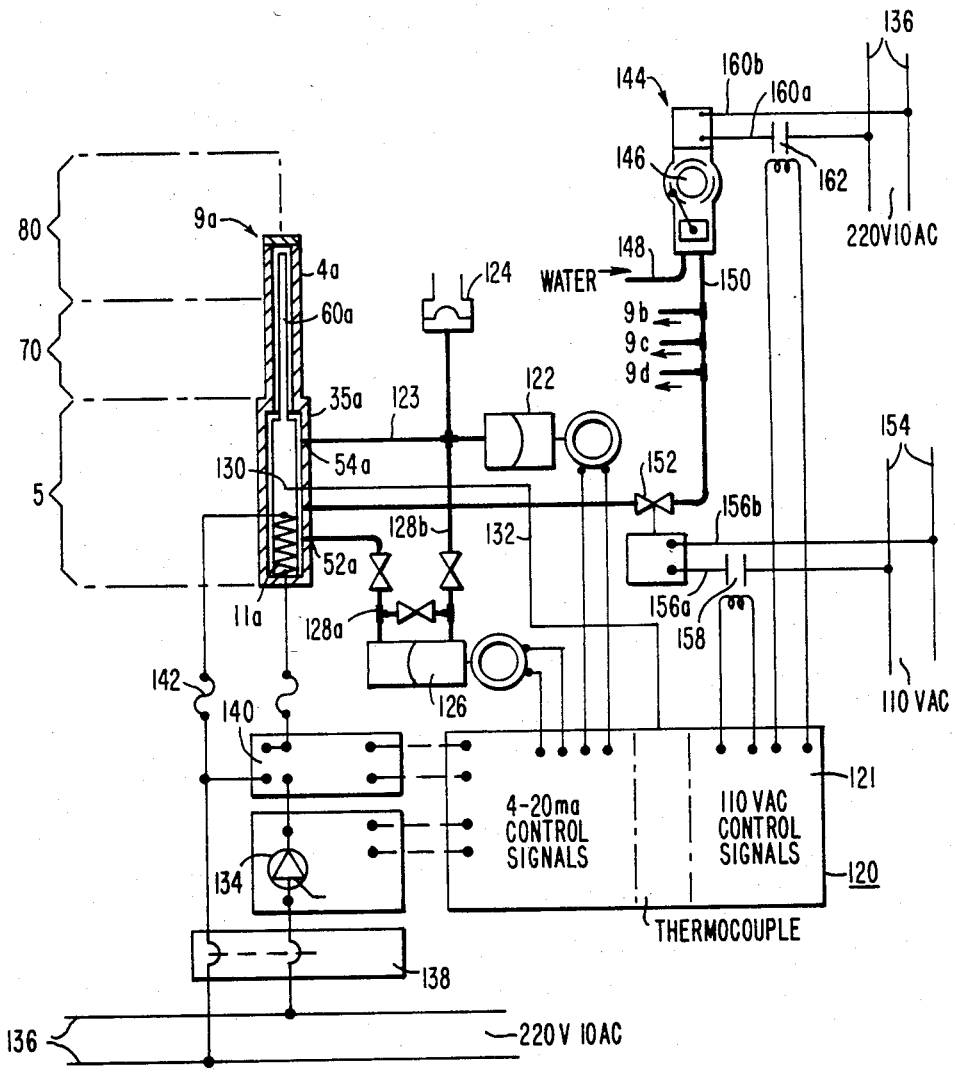
FIG. 4 is a schematic representation of the control system used in each of the individual primary systems which form the primary side of each of both preferred embodiments of the invention.

The steam which is generated from the transfer of heat between the sample tubes 4*a*, 4*b*, 4*c* and 4*d* and the feedwater within the secondary side 80 of the boiler vessel 3 passes through a separator assembly 100 which removes water vapor from the steam. From there, the dried steam flows through a centrally disposed bore 90 in the flanged end cap 88 of the secondary side 80. The sludge which results from the constant evaporation of the feedwater within the secondary side 80 collects within a sludge cup (not shown) present on the top end of the tubesheet 70 where it accumulates around the sides of the sample tubes 4*a*, 4*b*, 4*c* and 4*d*, and within the annular space between the tubesheet bores 74*a*, 74*b*, 74*c* and 74*d* and the outside surfaces of the sample tubes 4*a*, 4*b*, 4*c* and 4*d*. The corrosive chemicals formed with the sludge will corrode the exterior walls of each of the sample tubes 4*a*, 4*b*, 4*c* and 4*d* at a rate which is primarily dependent upon the individual heat flux and surface temperature of the tube, which in turn is individually selected for each of the tubes by means of the separate control system 120 which is illustrated in FIG. 4. At the outset, it should be noted that far more detailed descriptions of the tubesheet 70, the secondary side 80, and all of the various feedwater systems, condensing systems, blow-down systems, general control systems and mounting arrangements therefor are set forth in the text of U.S. patent application Ser. Nos. 636,437, 636,438, 636,449 and 636,450, all filed on July 31, 1984 and assigned to the Westinghouse Electric Corporation, the entire texts of which are hereby expressly incorporated herein by reference.

Because the principal differences between the model steam generator claimed and disclosed in these patent applications in the instant invention lies in the structure of the multiple primary systems 9*a*, 9*b*, 9*c* and 9*d* and their associated control systems 120*a*, 120*b*, 120*v* and 120*d*, the balance of this detailed description will focus on these two areas of the boiler vessel 3.

Figure 2A:
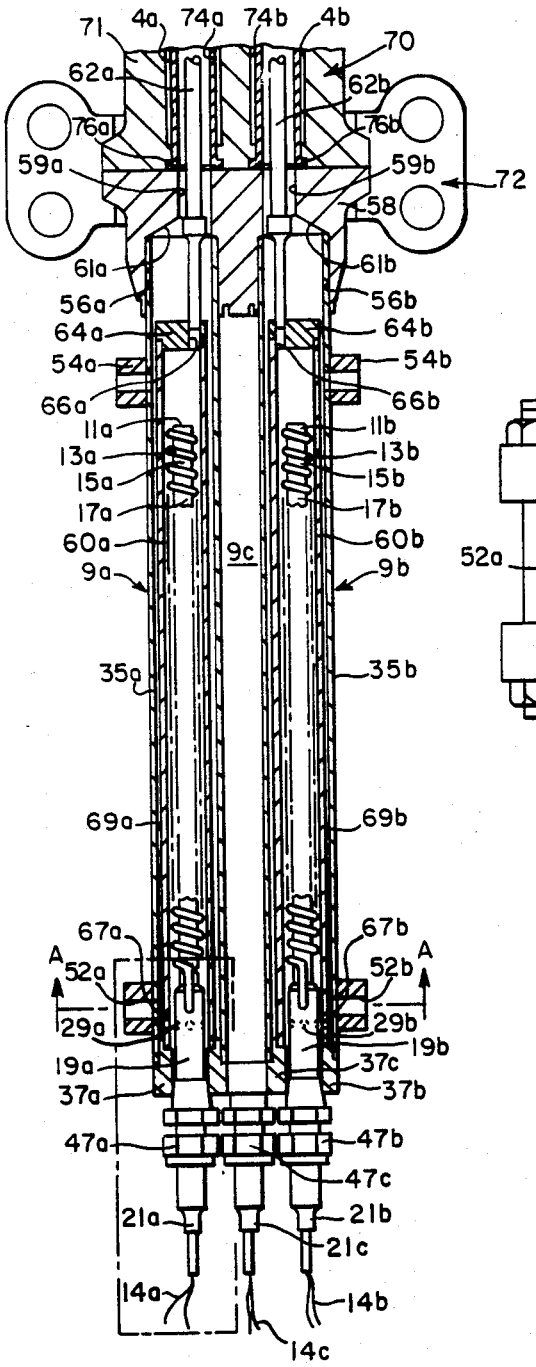
FIG. 2A is a cross-sectional side view of the primary side of the model steam generator illustrated in FIG. 1.
Figure 2B:
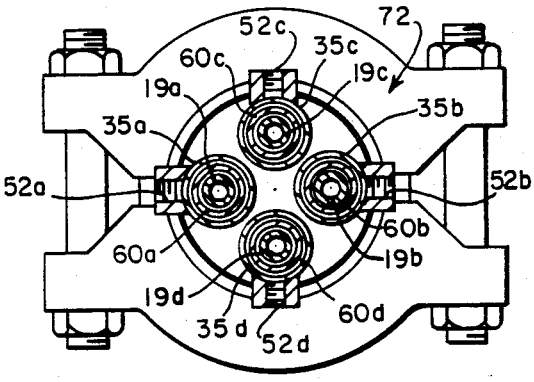
FIG. 2B is a cross-sectional view of the primary side illustrated in FIG. 2A along the line A—A.
Figure 2C:
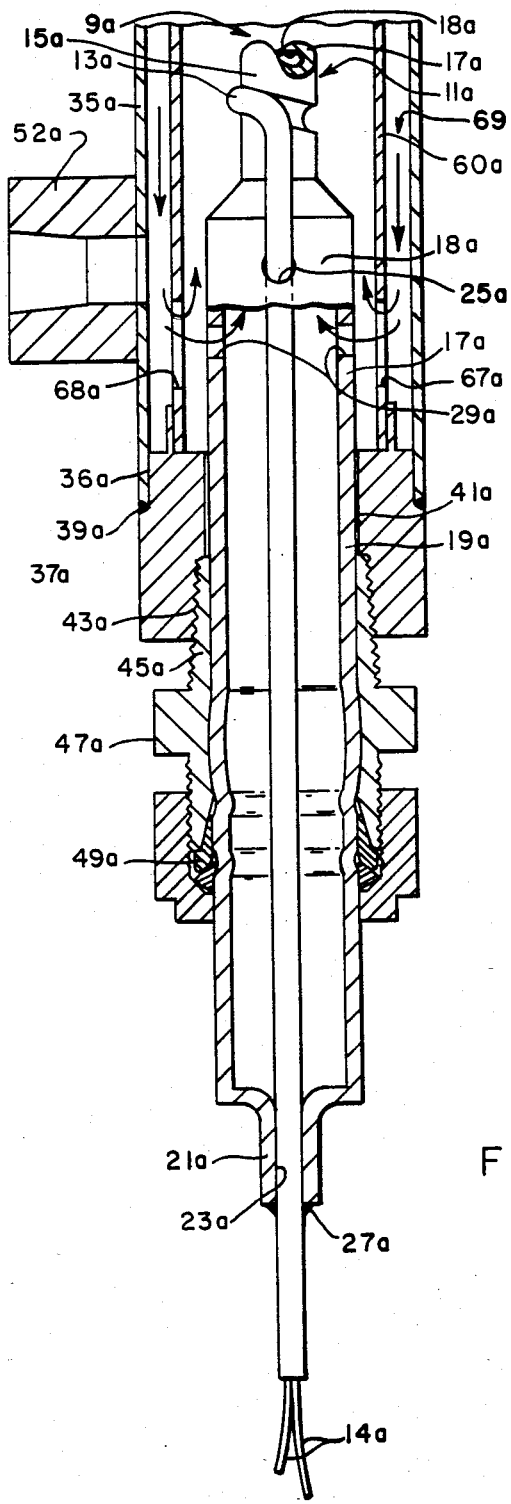
FIG 2C is a detailed view of the area circled in the lower, left hand section of FIG. 2A.

Detailed Description of the Structure and Operation of the Preferred Embodiment Turning now to FIGS. 2A, 2B and 2C, the primary side 5 of the boiler vessel 3 includes four separate primary systems 9*a*, 9*b*, 9*c* and 9*d* in the form of four individual thermosyphon cells. Each of these primary systems includes its own separately controllable electrical resistance heater 11*a*, *11b*, 11*c* and 11*d*, respectively. Each of these electrical resistance heaters is formed from a rod heating element 13*a*, 13*b*, 13*c* and 13*d* coiled about a mandrel 15*a*, 15*b*, 15*c* and 15*d*. As shown in the preferred embodiment, each of the heating elements 13*a*, 13*b*, 13*c* and 13*d* is a Model BXX-0913-48-4T rod heater, manufactured by ARI Industries, Inc. located in Franklin Park, Illinois. Structurally, each of these heating elements 13*a*, 13*b*, 13*c* and 13*d* is formed from an inner electrical resistance element of aluminum oxide or manganese oxide sheathed in a heat- and corrosion-resistant material such as Incoloy ®800. Each of these heating elements has a maximum energy output of 6 kilowatts, and is connected to a 220 volt power source 136 (which forms part of its associated control system to be discussed in detail hereinafter) by way of electrical connecting lead pins 14*a*, 14*b*, 14*c* and 14*d*. In the preferred embodiment, each of the rod heating elements 13*a*, 13*b*, 13*c* and 13*d* are preferably coiled (or otherwise densely configured) around a mandrel 15. Because the structure of each of the electrical resistance heaters 11*a*, 11*b*, 11*c* and 11*d* is identical, the following description of structural details will refer only to electrical resistance heater 11*a*, it being understood that this description applies equally to heaters 11*b*, 11*c* and 11*d*.

With specific reference now to FIG. 2C, the mandrel 15 of the electrical resistance heater 11*a* includes both a tube portion 17*a* having a hollow interior 18*a* and a hollow, cylindrical base 19. The heating element 13*a* is preferably coiled around the tube portion 17*a* at a pitch of approximately 5 and $\frac{3}{8}$ loops per inch, which leaves approximately 3/32nds of an inch of space between adjacent loops. Although not expressly shown in the several figures, the outside surface of the tubular portion 17*a* preferably includes a helical groove for receiving and seating the loops of the rod-shaped heating element 13*a*. This helical groove advantageously maintains proper spacing between the loops formed by the heating element 13*a* by preventing these loops from "gathering" as a result of any incidental friction they experience when they are slid into the tubular pressure chamber 35*a* which houses the electrical resistance heater 11*a*. Turning now to the hollow, cylindrical base 19*a* of the mandrel 15*a*, the bottom portion of the base 19*a* terminates in a nipple 21*a* having a centrally disposed bore 23*a* through which the lower portion of the heating element 13*a* extends. The top portion of the base 19*a* includes a laterally disposed bore 32*a* through which the balance of the heating element 13*a* extends, as well as a pair of lateral fluid ports 29*a* and 29*b* which advantageously allow water to circulate upwardly through the hollow interior 18*a* of the tube portion 17*a*. Finally, in order to maintain the necessary pressure boundary between the interior of the cylindrical base 19*a* and the ambient atmosphere, a weld joint 27*a* formed from a circular bead of welding metal sealingly connects the end of the nipple 21*a* and the outer surface of the lower portion of the heating element 13*a* as shown. While the invention would be operable if the tube portion 17*a* of the electrical resistance heater 11*a* were a solid rod instead of a hollow tube, the provision of a hollow, tube portion 17*a* and the mandrel 15*a* facilitates the transfer of heat between the heating element 13*a* and the water in the primary system 9*a* by providing approximately 20% more surface contact between the heating element 13*a* and the water which normally surrounds this element.

With reference again to FIGS. 2A, 2B and 2C, each of the separate primary systems 9*a*, 9*b*, 9*c* and 9*d* is housed within an elongated, tubular chamber 35*a*, 35*b*, 35*c* and 35*d*. At their lower ends, each of these chambers is sealingly engaged around an annular recess 36*a*, 36*b*, 36*c* and 36*d* of a bottom plug 37*a*, 38*b*, 37*c* and 37*d*, by means of weld joints 39*a*, 39*b*, 39*c* and 39*d*, respectively. Like weld joint 27*a*, each of these weld joints 39*a*, 39*b*, 39*c* and 39*d* is formed from a circular bead of weld material. In order to accommodate the insertion of the electrical resistance heaters 11*a*, 11*b*, 11*c* and 11*d* within the separate primary systems, each of the bottom plugs 37*a*, 37*b*, 37*c* and 37*d* further includes a centrally disposed bore 41*a*, 41*b*, 41*c* and 41*d* which flares out into a tapered, threaded mouth 43*a*, 43*b*, 43*c* and 43*d* for threadedly engaging the male portion 45*a*, 45*b*, 45*c* and 45*d* of a compression fitting 47*a*, 47*b*, 47*c* and 47*d*. In the preferred embodiment, each of the compression fittings 47*a*, 47*b*, 47*c* and 47*d* may be either a Hoke Gyrolok ® fitting, manufactured by Hoke, Inc. of Cressel, N.J., or a Swagelok ® fitting, manufactured by Crawford Tool Company of Solon, Ohio. As may best be seen with reference to FIG. 2C, each of the compression fittings 47*a*, 47*b*, 47*c* and 47*d* is sealingly engaged to the cylindrical base 19*a*, 19*b*, 19*c* and 19*d* of its respective electrical resistance heater by means of a weld joint 49*a*, 49*b*, 49*c* and 49*d*.

As may best be seen with reference to FIG. 2A, each of the tubular chambers 35*a*, 35*b*, 35*c* and 35*d* which houses the separate primary systems 9*a*, 9*b*, 9*c* and 9*d* includes both a lower fluid port 52*a*, 52*b*, 52*c* and 52*d*, as well as an uppr fluid port 54*a*, 54*b*, 54*c* and 54*d*, respectively. Each of the lower fluid ports 52*a*, 52*b*, 52*c* and 52*d* hydraulically connects the interior of its respective tubular chamber 35*a*, 35*b*, 35*c* and 35*d* to a separate differential pressure cell 126*a*, 126*b*, 126*c* and 126*d*, while each of the upper fluid ports 54*a*, 54*b*, 54*c* and 54*d* hydraulically connects its respective tubular chamber to an absolute pressure cell 122*a*, 122*b*, 122*c* and 122*d*. As will be discussed in more detail hereinafter, these hydraulic connections are part of the control system 120*a*, 120*b*, 120*c* and 120*d* of each of the primary systems 9*a*, 9*b*, 9*c* and 9*d*. In addition to the upper and lower fluid ports for the differential and absolute pressure cells, each of the tubular chambers 35*a*, 35*b*, 35*c* and 35*d* also includes a coupling (not shown) for hydraulically connecting the interiors of each of these chambers with the output conduit of the charging pump 146 of the control systems 120*a*, 120*b*, 120*c* and 120*d* in order that a proper amount of water may be maintained within each of these tubular chambers. The upper end of each of the tubular chambers 35*a*, 35*b*, 35*c* and 35*d* is received within a cylindrical bore 56*a*, 56*b*, 56*c* and 56*d* which is present in the lower end of the primary end cap 58. Each of these relatively large, cylindrical bores 56*a*, 56*b*, 56*c* and 56*d* connects with a relatively narrow, offset bore 59*a*, 59*b*, 59*c* and 59*d* through a funnel shaped recess, 61*a*, 61*b*, 61*c* and 61*d*, respectively. As will be presently explained, the purpose of this particular bore configuration is to accommodate the extensions of the riser tubes 60*a*, 60*b*, 60*c* and 60*d* which form a necessary part of the thermosyphon mechanism present in each of the separate primary systems 9*a*, 9*b*, 9*c* and 9*d*.

With reference again to FIGS. 2A, 2B and 2C, each of the tubular pressure chambers 35*a*, 35*b*, 25*c* and 35*d* includes a concentrically disposed riser tube 60*a*, 60*b*, 60*c* and 60*d* which completely circumscribes the electrical resistance heater 11*a*, 11*b*, 11*c* and 11*d* present in each of these cells. Each of the riser tubes 60*a*, 60*b*, 60*c* and 60*d* includes a relatively narrower riser tube extension 62*a*, 62*b*, 62*c* and 62*d* which is concentrically disposed within its respective sample tube 4*a*, 4*b*, 4*c* and 4*d*. In the preferred embodiment, each of the riser tube extensions 62*a*, 62*b*, 62*c* and 62*d* includes a completely open top end which extends to about 1½ inches from the closed end of its respective sample tube. In order that all of the steam generated within the riser tube 60*a*, 60*b*, 60*c* and 60*d* might be directed to the end of its respective sample tube, coupling plates 64*a*, 64*b*, 64*c* and 64*d* are sealingly engaged to the ends of each of the riser tubes 60*a*, 60*b*, 60*c* and 60*d*. Each of these coupling plates includes an offset bore 66*a*, 66*b*, 66*c* and 66*d* into which the end of a relatively short, connecting tube is engaged which fluidly connects each riser tube to its respective extension. As is indicated in FIG. 2A, each of these connecting tubes includes a flared end for frictionally receiving the end of the riser tube extension 62*a*, 62*b*, 62*c* and 62*d*. The provision of a non-permanent, friction fit between the bottom ends of the riser tube extension 62*a*, 62*b*, 62*c* and 62*d* in the flared upper ends of the coupling tubes renders it easy for the operator of the model steam generator to disconnect the primary side 5 of the boiler vessel 3 from the bottom end of the tubesheet 70 upon completion of one or more of the corrosion monitoring tests. As may best be seen with reference to FIG. 2C, the bottom section of each of the riser tubes 60*a*, 60*b*, 60*c* and 60*d* is received and joined within a complimentary, annular recess in bottom plug 37*a*, 37*b*, 37*c* and 37*d*. Just above the junction between the bottom edge of these riser tubes and their respective bottom plugs, each of these riser tubes includes a pair of fluid inlet ports 67*a*, 67*b*, 67*c* and 67*d* and 68*a*, 68*b*, 68*c* and 68*d*. As is indicated by the fluid flow arrows in FIG. 2C, the purpose of these fluid inlet ports is to allow recirculating condensate flowing down from between the annular space between the outer surface of the riser tube 60*a*, 60*b*, 60*c* and 60*d* and the inner surface of the tubular chambers 35*a*, 35*b*, 35*c* and 35*d* to flow either along the outside or inside surface of the tube portion 17*a*, 17*b*, 17*c* and 17*d* of the heater 11*a*, 11*b*, 11*c* and 11*d*. More specifically, these ports direct this recirculating flow both over the coil windings of the electrical heating element 13*a*, 13*b*, 13*c* and 13*d*, and through the lateral fluid ports 27*a*, 27*b*, 27*c* and 27*d* located in the cylindrical bases of the heaters 11*a*, 11*b*, 11*c* and 11*d* in order that the recirculating condensate might be reconverted into steam by contacting the inner walls of the hollow tube portion 17*a*, 17*b*, 17*c* and 17*d* of the mandrels. In closing, it should be noted that the riser tube 60*a*, 60*b*, 60*c* and 60*d* in each of the primary systems 9*a*, 9*b*, 9*c* and 9*d* simultaneously functions as a "downcomer" tube by defining an annular flowpath between the outside surface of the tubes 60*a*, 60*b*, 60*c* and 60*d* and the inside surfaces of the surrounding chambers through which the returning condensate may circulate. This arrangement is a significantly more compact design that the provision of separate riser and downcomer tubes, and is one of several design features which considerably reduces both the size and weight of the primary side 5 of the boiler vessel 3.

Turning back to FIG. 2A, the tubesheet 70 of the boiler vessel 3 includes a cylindrical body 71 which is detachably coupled onto the top of the primary side 5 by means of a Grayloc® clamping assembly 72. The tubesheet 70 includes an array of bores 74*a*, 74*b*, 74*c* and 74*d* which are preferably mutually spaced from one another at the same (or greater) square pitch as the tube bores in the tubesheet of the full-scale generator being monitored, which is about 1.06 in. Additionally, these bores 74*a*, 74*b*, 74*c* and 74*d* are slightly larger in diameter than the outer diameter of the sample tubes 4*a*, 4*b*, 4*c* and 4*d* which they concentrically surround so that an annular space exists between the outer surface of the tube and the inner surface of its respective housing bore when the sample tubes 4*a*, 4*b*, 4*c* and 4*d* are mounted in the position illustrated in FIG. 2A. As is further indicated in FIG. 2A, these tube bores 74*a*, 74*b*, 74*c* and 74*d* are further registrable with the offset bores 59*a*, 59*b*, 59*c* and 59*d* so that the tube bores may be precisely aligned with the offset bores when the tubesheet 70 is clamped together with the primary side 5 by means of the Grayloc® clamping assembly 72. Finally, metal O-rings 75*a*, 75*b*, 75*c* and 75*d* are provided in the junctions between the tube bores 74*a*, 74*b*, 74*c* and 74*d* and the offset bores 59*a*, 59*b*, 59*c* and 59*d* and the offset bores 59*a*, 59*b*, 59*c* and 59*d* in order to pressure-isolate each of the primary systems 9*a*, 9*b*, 9*c* and 9*d*. In the preferred embodiment, each of these O-rings is fabricated from silver-plated or nickel-plated Inconel.

Turning back now to FIG. 1, the secondary side 80 of the boiler vessel 3 generally includes a cylindrical housing 82 having a lower flange which is connected to an upper flange of the tubesheet 70 by means of another Grayloc® coupling 84. The outside surface of to cylindrical housing 82 includes a feedwater inlet 86 which is connected to a source of feedwater (not shown) which is preferably substantially identical in chemical composition to the feedwater used in the full-scale steam generator. The secondary side 80 of the boiler vessel 3 further includes a flanged end-cap 88 which is detachably mounted onto the top edge of the cylindrical housing 82 by means of still another Grayloc® assembly 92. This flanged end-cap 88 includes a centrally disposed threaded bore for threadedly receiving a steam-outlet coupling (also not shown). Concentrically disposed within the interior of the cylindrical housing 82 of the secondary side 80 is a riser barrel 95 which terminates in a riser barrel cap 97. This barrel cap 97 includes a steam opening 99 which, as indicated in FIG. 1, is preferably in alignment with the centrally disposed threaded bore 90 in the flanged end cap 88. A separator assembly 100 is provided within the riser barrel 95 in order to separate the droplets of water from the steam generated within the secondary side 80. The separator assembly generally includes a plurality of large-droplet separator grids 102 at its bottom portion, as well as a plurality of small-droplet separator grids 104 at its upper portion. The large-droplet separator grids 102 are preferably inclined at a slight angle to the horizontal as shown in order to promote a flow of condensate down along the inner walls of the riser barrel 95 when the column of wet steam generated by the transfer of heat from the sample tubes 4*a*, 4*b*, 4*c* and 4*d* into the surrounding feedwater flowing through these grids. By contrast, the small-droplet separator grids are preferably substantially horizontally disposed as shown. These small droplet separator grids rely on the tendency of the droplets of water which impinge thereon to migrate laterally in order for the condensate formed therefrom to flow back along the inner walls of the riser barrel 95. For a more detailed description of both the structure and operation of the tubesheet 70, the secondary side 80 and the separator assembly 100, reference is again made to the model steam generator described and claimed in the aforementioned U.S. patent application Ser. Nos. 636,437, 636,438, 636,449 and 636,450.

Turning now to FIGS. 3A, 3B, 3C and 3D, the second preferred embodiment of the invention includes a combined primary side and tubesheet 110 which allows for an even greater amount of longitudinal compaction of the boiler vessel 3. Since the bores 74*a*, 74*c*, 74*c* and 74*d* not only house the sample tubes 4*a*, 4*b*, 4*c* and 4*d* but also serve the same function as the chambers 35*a*, 35*b*, 35*c* and 35*d* in the first embodiment, this configuration also has the added advantage of reducing the size of the primary side 3 along its diameter, since the chambers of the primary systems provided by the bores 74*a*, 74*b*, 74*c* and 74*d* are only slightly larger than the diameter of the sample tubes which they house. By contrast, the diameter of the chambers 35*a*, 35*b*, 35*c* and 35*d* of the first embodiment are almost twice the diameter of the sample tubes 4*a*, 4*b*, 4*c* and 4*d*.

Turning now to a more detailed description of the tube housing bores 74*a*, 74*b* and 74*c* and 74*d*, the square pitch of these bores in the combined tubesheet and primary side 110 is preferably about the same as the square pitch of the tube housing bores of the tubesheet of the full-scale generator being monitored (which again is approximately 1.06 in.). Additionally, each of these bores 74*a*, 74*b*, 74*c* and 74*d* has a somewhat larger inner diameter than the outside diameter of the respective sample tube which it houses. An annular space (which may best be seen with respect to FIG. 3B) exists between the inside surface of each of these bores and the outside surfaces of each of the sample tubes 4*a*, 4*b*, 4*c* and 4*d*. The provision of such an annular space is important, since such annular spaces exits between the heat exchange tubes and the tubesheets of the full-scale generators being monitored, and are often the location of corrosive chemicals and sludge accumulation and consequent tube corrosion.

Figure 3A:
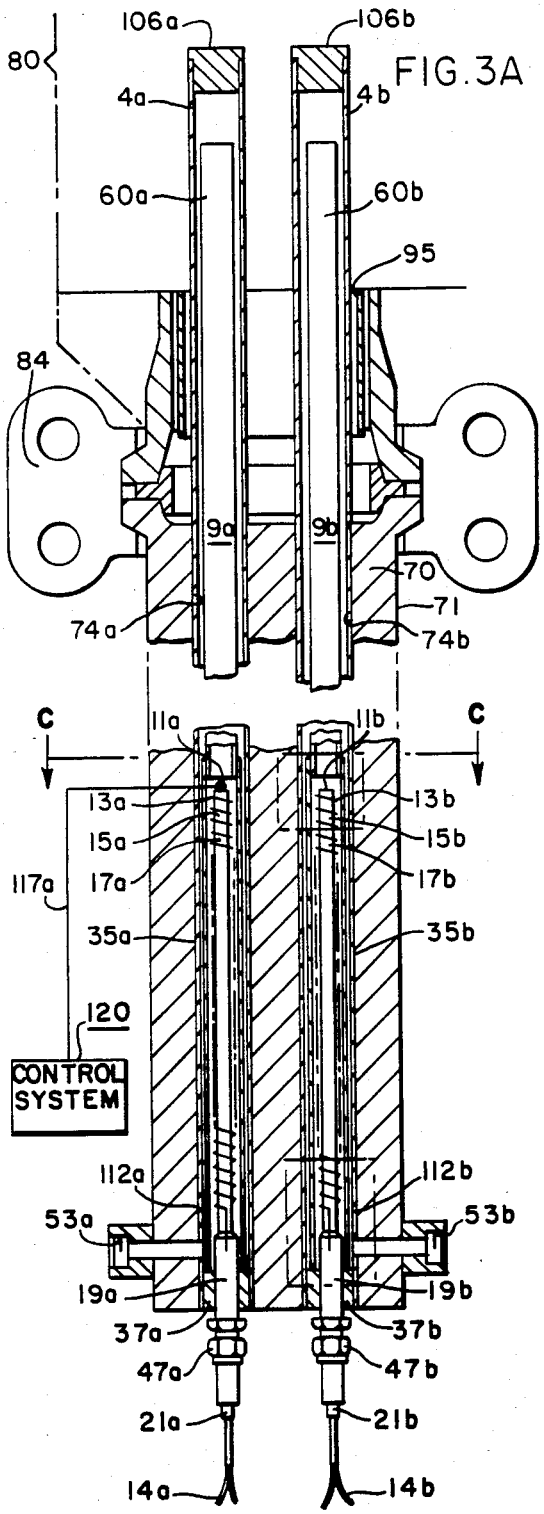
FIG. 3A is a cross-sectional side view of the primary side of a second preferred embodiment of the invention, wherein the separate primary systems are integrated within the tubesheet.
Figure 3D:
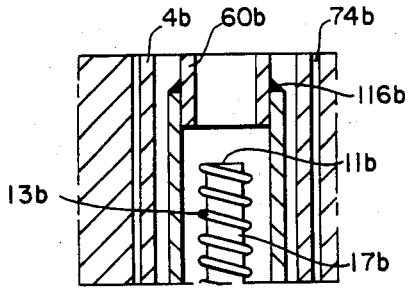
FIG. 3D is an enlarged, detailed view of the portion of FIG. 3A surrounded by the upper dotted circle.
Figure 3C:
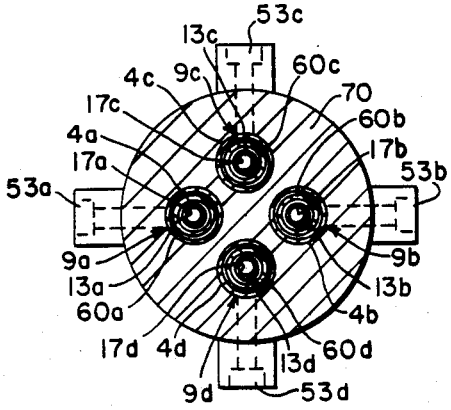
FIG. 3C is a cross-sectional view of the primary side illustrated in FIG. 3A taken along the line A—A.
Figure 3B:
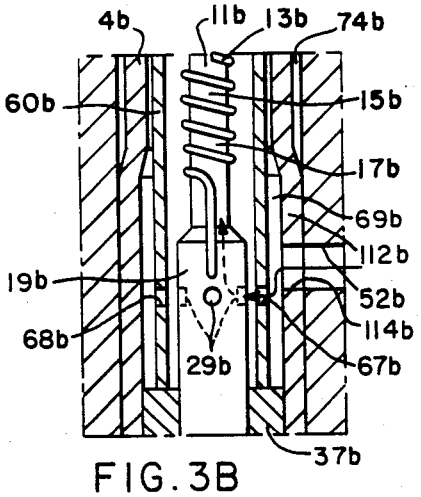
FIG. 3B is an enlarged, detailed view of the portion of FIG. 3A surrounded by the lower dotted circle.

As may further be seen best with respect to FIGS. 3B, the lower ends of the sample tubes 4*a*, 4*b*, 4*c* and 4*d* are hydraulically expanded against the inner walls of their respective tube housing bores 74*a*, 74*b*, 74*c* and 74*d* for two reasons. First, such an expansion helps to mechanically secure the ends of the sample tubes within the combined tubesheet and primary side 110. Secondly, since such a tube expansion is present in the full-scale generator being monitored, the provision of such a expansion in the model steam generator enhances the ability of the model steam generator to accurately simulate the thermonhydraulic conditions with the full-scale generator. To this end, the length of this tube expandion should match the length of the expansion present in the full-scale steam generator. It should also be noted that such an expansion has the effect of providing a somewhat larger water reservoir around the cylindrical bases 19*a*, 19*b*, 19*c* and 19*d* of the electrical resistance heaters 11*a*, 11*b*, 11*c* and 11*d*. This in turn, facilitates the circulation of water through the thermosyphon mechanism contained within the sample tube bores 74a, 74b, 74c and 74d by lowering the amount of fluid resistance which the water experiences as it flows down through the annular space between each of the riser tubes 60a, 60b, 60c and 60d and the inside walls of its respective sample tube 4a, 4b and 4c 4d through the fluid ports 67a, 67b, 67c and 67d and 68a, 68b, 68c and 68d in these riser tubes.

Apart from the fact that the tubesheet in the second preferred embodiment doubles as the primary side, with the tube housing bores 74a, 74b, 74c and 74d displacing the function and structure of the previously described chambers 35, 35b, 35c and 35d, there are only two major differencs between the structure of the first preferred embodiment illustrated in FIGS. 1 and 2A, 2B and 2C and the second preferred embodiment illustrated in FIGS. 3A, 3B and 3C and 3D.

The first of these differences is that the riser tubes 60a, 60b, 60c and 60d maintain substantially the same diameter throughout their entire length due to the fact that the maximum outer diameter that these tubes can assume is, of course, limited by the extent of the inner diameter of the sample tubes 4a, 4b, 4c and 4d. As best shown with respect to FIG. 3D, each of the riser tubes 60a, 60b, 60c and 60d is in reality formed from two tubes having slightly different diameters which are joined at junctions 116a, 116b, 116c and 116d. The lower section of the riser tubes 60a, 60b, 60c and 60d houses the electrical resistance heaters 11a, 11b, 11c and 11d, and the somewhat larger outer diameter of the riser tube which surrounds the electrical resistance heaters 11a, 11b, 11c and 11d provides enough annular clearance between the outer diameter of these electrical resistance heaters and the inner diameter of these riser tubes so that the electrical resistance heaters may be easily inserted into their respective riser tubes without any mechanical binding, and a minimum of incidental friction. Such friction could damage the heating elements 13a, 13b, 13c and 13d, and might compress some of the coil windings of these heating elements 13a, 13b, 13c and 13d closer together at some points than at others, which in turn could result in undesirable "hot spots" or short circuiting along the longitudinal axes of the various heaters 11a, 11b, 11c and 11d. While the larger outer diameter could conceivably be used throughout the entire length of the riser tubes 60a, 60b, 60c and 60d, the provision of a narrower section of tubing for the longitudinal section extending above the electrical resistance heaters 11a, 11b, 11c and 11d creates a larger annular gap between the outer surface of each of the riser tubes and the inner surfaces of its respective sample tubes. This larger annular gap in turn facilitates the circulation of condensate back down from the inner walls of the sample tubes to the reservoir created by the expanded portions 112a, 112b, 112c and 112d of the sample tubes 4a, 4b, 4c and 4d, respectively.

The second major structural difference between the second and first preferred embodiments of the invention is the provision of an emergency water level alarm in the form of a thermocouple 117a, 117b, 117c and 117d placed just above the upper end of the heating element 13a, 13b, 13c and 13d of each of the electrical resistance heaters 11a, 11b, 11c and 11d. In order to simplify FIG. 3A, the relative positioning of these thermocouples is shown only with respect to primary system 9a; however, an identical thermocouple 117b, 117c and 117d is present in the same location in each of the other primary systems 9b, 9c and 9d, respectively. Additionally, each of these thermocouples 117a, 117b, 117c and 117d are electrically connected to the microprocessor 121 of the control system 120a, as is schematically illustrated in FIG. 3A. Before a detailed description is given of the control system 120 of this second preferred embodiment of the invention, the control system used in the first embodiment will be considered.

FIG. 4 is a schematic representation of the control system 120a, 120b, 120c and 120d used in each of the primry system 9a, 9b, 9c and 9d to control the heat flux of the sample tubes 4a, 4b, 4c and 4d, the water levels within the pressure chambers 35a, 35b, 35c and 35d, and the presure differential between these chambers and the secondary side 80 of the boiler vessel 3. Since the structure of each of these control systems are identical reference will be made only to control system 120a in order to avoid prolixity.

Control system 120 includes a microcomputer 121 which is preferably a Model 550PM microcomputer manufactured by Texas Instruments, Inc., of Dallas, Texas. Preferably, the same microcomputer 121 is used in all four control systems 120a, 120b, 120c and 120d to avoid needless duplication of components. On its input and output sides, the microcomputer 121 may include one or more Model 7MT 100 and 7MT 200 Texas Instruments modules, respectively, connected together in a fashion well known to those skilled in the art of computer controls. This control system 120 further includes an over-pressure sensor and a water level monitor in the form of an absolute pressure cell 122, and a differential pressure cell 126. The absolute pressure cell is connected to the previously mentioned upper fluid port 54a by means of a pressure conduit 123. The electrical output of the absolute pressure cell 122 is electrically connected to the input of the microcomputer 121 by means of a pair of cables, as indicated. If this absolute pressure cell 122 should even transmit an electrical signal to the input of the microcomputer 121 indicative of an over-pressure condition within the chamber 35a, the microcomputer 121 is programmed to open the breaker circuit 138 so that all electrical power is disconnected from the electrical resistance heater 11a. However, as an additional safeguard against any such over-pressure condition, a rupture disc 124 is hydraulically connected to pressure conduit 123 as indicated. This rupture disc 124 is calibrated to burst if the pressure within the tubular chamber 35a should ever rise above a preselected point indicative of an imminent boiler-burst condition. Turning now to the lower differential pressure cell 126, one side of the cell is fluidly connected to the lower fluid port 52a of the tubular pressure chamber 35a by means of a pressure conduit 128a, while the other side is pneumatically connected to the aforementioned pressure conduit 123 via pressure conduit 128b. The electrical output of the lower differential pressure cell 126 is connected to the input of the microcomputer 121 by suitable electrical cables, as indicated. Because the two sides of the differential pressure cell 126a are connected across the lower and upper fluid ports 52a and 52b, the microcomputer 121 can compute the level of the water within the tubular pressure chamber 35a by monitoring any pressure transmitted to it by the cell 126. For the most part, this pressure reading should remain unchanged throughout any test which is conducted upon the sample heat exchange tube 4a. However, should sample tube 4a crack so that water from its primary system leaks into the secondary side 80 of the boiler vessel 3, the differential pressure between the lower and upper fluid ports 52*a* and 54*b* would change rapidly and substantially due to the small size of the liquid reservoir within each of the primary systems 9*a*, 9*b*, 9*c* and 9*d*. In the preferred embodiment, the microcomputer 121 of the control system 120 is programmed to deactuate the electrical resistance heater associated with any such cracked sample tube in order to minimize any contaminating flow between the water in the primary side 5 and the feedwater in the secondary side 80. When any one of the electrical resistance heaters 11*a*, 11*b*, 11*c* and 11*d* is deactuated by the microcomputer 121 in this manner, it should be noted that each of the other corrosion monitoring tests being carried out on the sample tubes 4*b*, 4*c* and 4*d* may be continued without any interruptions whatsoever since each of the primary systems 9*a*, 9*b*, 9*c* and 9*d* are pressure-isolated from one another.

Turning now to the manner in which each of the control systems 120*a*, 120*b*, 120*c* and 120*d* normally control the amount of heat flux flowing through its respective sample heat exchange tube, control system 120*a* further includes a thermocouple 130 disposed within the tubular chamber 35*a* above the electrical resistance heater 11*a*. The electrical output of this thermocouple is connected to the input of the microcomputer 121 by means of an electrical cable 132. Also connected to the input of the microcomputer 121 is the output of a watt meter 140. As is indicated in FIG. 4, this watt meter is serially connected to one of the power cables leading into the heating element 13*a* of the electrical resistance heater 11*a*. Either the thermocouple 130 or the watt meter 140 may be used to control the heat flux radiated out of the end of the sample tube 4*a*. Generally, the thermocouple method of control is preferred when the operator is concerned with maintaining a given sample tube temperature within the annular space between the tubesheet bore 74*a* and the outside surface of the sample tube 4*a*. However, the watt meter 140 may optionally be used in conjunction with a simple program which may be entered into the memory of the microprocessor 121 which converts a desired amount of heat flux to a specific electrical power input into the electrical resistance heater 11*a*, and which further regulates the gate of the SCR 134 so that this associated amount of electrical power is indeed admitted into the heating element 13*a* of the electrical resistance heater 11*a*. Regardless of which mode of control is used, it should be noted that the operator of the control system should compensate for the incidental heat migration which occurs in the tubesheet 70 when the various primary systems 9*a*, 9*b*, 9*c* and 9*d* are operated at different heat fluxes. For example, if the tubes 4*a* and 4*b* are being operated at fluxes equivalent to "hot leg" thermohydraulic conditions while tubes 4*c* and 4*d* are run at "cold leg" conditions, it may be necessary to operate the "hot leg" tubes at a slightly higher temperature, and the "cold leg" tubes at a slightly lower temperature than would normally be associated with a correctly-simulative heat flux due to the fact that some significant amount of heat will flow through the tubesheet 70 from the "hot legs" 4*a* and 4*b* to the "cold legs" 4*c* and 4*d*. Such a compensating operation should also be used with respect to the second preferred embodiment of the model steam generator, since this same undesired heat transfer between "hot leg" and "cold leg" sample tubes would occur in the combined primary system and tubesheet 110. To reduce (or at least minimize) this spurious heat flow, both the tubesheet 70 of the first embodiment and the combined primary system and tubesheet 110 of the second embodiment might be cut into quadrant-shaped sectors, with a cruciform ceramic insulator disposed between these sectors.

Before moving onto a detailed description of the charging system 144 which is part of the control system 120, it should be noted that the power cables leading to the electrical resistance heater 11*a* include both a circuit breaker 138, as well as a set of conventional fuses 142 in order to protect the electrical resistance heater 11*a* (and all of the power circuitry connected thereto) from a power surge in the event of a short-circuit or other malfunction.

The charging system 144 of the control system 120*a* generally includes a charging pump 146 having an inlet conduit 148, and an outlet conduit 150. The inlet conduit 148 is preferably hydraulically connected to a source of purified demineralized water in order to minimize the amount of scale or corrosion within the tubular chambers 35*a*, 35*b*, 35*c* and 35*d*. The outlet conduit 150 preferably includes a manifold structure which connects the outlet of the charging pump 146 to the charging ports (not shown) of each of the tubular chambers 35*a*, 35*b*, 35*c* and 35*d*. The provision of such a manifold structure obviates the need for multiple charging pumps. An electrically controlled valve 152 is serially connected between the output of the charging pump 146, and the charging port of each of the tubular chambers 35*a*, 35*b*, 35*c* and 35*d*. This electrically controlled valve 152 is connected to 110 volt power source 154 by means of electrical cables 156*a* and 156*b*. A normally open relay 158 is serially connected with an electrical cable 156*a*. The control leads of this normally open relay 158 are connected to microprocessor 121 of the control system 120*a*. Additionally, the charging pump 146 is connected to a 220 volt power supply by means of power cables 160*a* and 160*b*, and a normally-open relay 162 is likewise serially connected within power cable 160*a*. As was the case with the normally-open 110-volt relay 158, the output of the microcomputer 121 is electrically connected to the charging pump relay 162. The control system 120*a* controls the water level within the tubular chambers 35*a*, 35*b*, 35*c* and 35*d* by monitoring this water level in the manner previously described by means of differential pressure cell 126, and by periodically opening the electrically controlled valve 152 and actuating the charging pump 146 to administer additional primary water through the charging port within the particular chamber whenever the differential pressure cell 126 indicates that the water level within this chamber has fallen beneath a preselected level. While the charging system 144 may be used to continuously replenish the water within a tubular chamber connected to a cracked sample tube, this charging system 144 is normally used only in the initial portion of the test to put a proper initial charge of water within the tubular chambers 35*a*, 35*b*, 35*c* and 35*d*.

The control system used in the second embodiment of the model steam generator is the same as the previously described control system 120 used in the first preferred embodiment with one major exception. Specifically, in addition to using a differential pressure cell 126 to sense the water level in the chambers 35*a*, 35*b*, 35*c* and 35*d* formed by the tube housing bores in the combined primary side and tubesheet 110, this control system further includes the previously described thermocouples 117*a*, 117*b*, 117*c* and 117*d* which are spaced just above the heating elements 13*a*, 13*b*, 13*c* and 13*d* in each of the bores 74*a*, 74*b*, 74*c* and 74*d* and electrically connected to the microcomputer 121 of the control system 120. If the water level in one of the tube-housing bores should fall to such an extent that the tip of its respective heating element becomes de-submerged, the temperature signal of its respective thermocouple 117*a*, 117*b*, 117*c* and 117*d* will rise substantially in a very short period of time, due to the fact that the steam surrounding the tip of the de-submerged heating element is a considerably poorer heat conductor than the water which normally surrounds this tip. In response to such a signal, the microcomputer 121 will automatically de-actuate the electrical resistance heater associated with this thermocouple. In both the first and second embodiments, if the loss of water inventory in the chamber of the primary system is the result of a cracked sample tube, the operator will normally allow the pressure to equilibrate between the primary side and the secondary side of the particular primary system affected while continuing to carry out the monitoring test of the remaining primary systems. If, however, the loss of water inventory was the result of a primary-to-atmosphere leak, such as may occur around the pressure fittings 47*a*, 47*b*, 47*c* and 47*d*, the operator has the option of re-charging the primary system affected with the charging system 144, and continuing the test.

In actual tests conducted by the applicants, the improved, compact model steam generator of the invention was capable of generating heat fluxes in the secondary water above the tubesheet 70 in the range from about $1\times10^4$ BTUs/ft.$^2$ per hour through about $1\times10^5$ BTUs/ft.$^2$ per hour, with an associated secondary side pressure of approximately 1,100 psig. Additionally, in both embodiments, while the end of the sample tubes 4*a*, 4*b*, 4*c* and 4*d* extending into the secondary side 80 may be as long as 24 inches, and 8- to 12-inch tube extension into the secondary side 80 is preferred when electrical resistance heaters of the aforementioned specifications are used. Finally, it should be noted that both embodiments of the invention are completely retrofittable onto the secondary side of the model steam generator described and claimed in the aforementioned U.S. patent application Ser. Nos. 636,437, 636,438, 636,449 and 636,450.

We claim as our invention:

1. An improved model steam generator for simultaneously simulating different sets of thermohydraulic conditions inside a full-scale steam generator in order to monitor the effect of these conditions on heat exchange tubes contained within a full-scale generator, comprising a boiler vessel having a primary and a secondary side, a plurality of sample heat exchange tubes for conducting heat from the primary to the secondary side, wherein said primary side includes a separate primary system for each sample tube, each of which circulates a flow of heated water within its respective tube for conducting heat to the secondary side of the boiler vessel, and a control means connected to each primary system for separately controlling the heat flux of each of the sample heat exchange tubes so that different heat exchange tubes transfer heat at different fluxes.

2. An improved model steam generator for simultaneously simulating one or more sets of thermohydraulic conditions inside a full-scale steam generator in order to monitor the effect of these conditions on heat exchange tubes contained in various locations within the full-scale generator, comprising:

(a) a boiler vessel fluidly connected to a source of water;

(b) a plurality of sample heat exchange tubes disposed within the boiler vessel for conducting heat to the water contained therein;

(c) a plurality of separate primary systems for each of the sample heat exchange tubes, each of which circulates heated water through the inside of the tube, and each of which has an independently controllable heat source that is thermally coupled to the water circulating through one of said sample heat exchange tubes for transmitting heat to said boiler vessel water through its respective sample tube, and (d) a control means connected to each of said heat sources for separately controlling the heat flux of each of the sample heat exchange tubes in thermal communication with said water so that different sample tubes transfer heat at different fluxes.

3. An improved model steam generator in accordance with claim 2, wherein each of the separate primary systems and their respective sample tubes are separately pressure sealed from one another.

4. An improved model steam generator in accordance with claim 3, wherein each of said sample tubes includes a closed end in thermal communication with said water, and an open end which is thermally coupled to its respective primary system.

5. An improved model steam generator in accordance with claim 4, wherein each primary system provides a re-circulating flow of vapor and condensate through the open end of its respective heat exchange tube, and includes a high-intensity electrical resistance heater formed from a coiled configuration of electrical resistance wire to minimize the length of the primary systems.

6. An improved model steam generator for simultaneously simulating one or more sets of thermohydraulic conditions inside of a full-scale steam generator in order to monitor the effect of these conditions on heat exchange tubes contained within the full-scale generator, comprising:

(a) a boiler vessel including a primary side, a tubesheet, and a secondary side fluidly connected to a source of water which may be used in the full-scale generator, wherein the primary side includes a plurality of primary systems, each of which has its own individual and separately controllable heat source;

(b) a plurality of sample tubes for conducting heat from the heat sources of the primary side of the boiler to the secondary side, wherein each of the tubes is thermally coupled at one end to a separate one of said heat sources through a separate, circulating flow of heated water generated by one of the primary systems, and is thermally coupled to the secondary side of the boiler vessel at its other end; and (c) a control means connected to each of the heat sources of the primary systems for separately controlling the heat flux of each of the ends of the sample heat exchange tubes thermally coupled to said secondary side so that different tubes transfer heat at different fluxes.

7. An improved model steam generator in accordance with claim 6, wherein each of the primary systems and its respective sample tube is independently pressure sealed, and further including a pressure control means for separately controlling the amount of pressure differential between each primary system and its respective tube and the secondary side.

8. An improved model steam generator in accordance with claim 7, further including means for separately sealing each of the primary systems with its respective sample tube.

9. An improved model steam generator in accordance with claim 7, wherein each of the primary systems includes a high-intensity electrical resistance heater formed from a coiled configuration of electrical resistance wire to minimize the length of the primary systems.

10. An improved model steam generator in accordance with claim 7, wherein said tubesheet houses each of the primary systems of said primary side in order to minimize the length of the boiler vessel.

11. An improved model steam generator in accordance with claim 7, wherein each primary system includes an elongated chamber for holding a reservoir of water, a heat source for boiling this water, and a thermosyphon means for circulating the resulting vapor and condensate over the inside walls of the end of its sample tube which thermally communicates with the secondary side.

12. An improved model steam generator in accordance with claim 11, wherein said tubesheet houses each of the primary systems of said primary side.

13. An improved model steam generator in accordance with claim 12, wherein each elongated chamber of the plurality of primary systems is formed from a bore in the tubesheet in order to minimize the length of the primary side.

14. An improved model steam generator in accordance with claim 11, wherein the cross-sectional area of each of said elongated chambers is, on the average, no more than about four times the cross-sectional area of its respective sample tube in order to render the primary side of the boiler diametrically compact.

15. An improved model steam generator in accordance with claim 13, wherein the cross-sectional area of each of said elongated chambers is substantially the same as the cross-sectional area of its respective sample tube in order to render the primary side of the boiler diametrically compact.

16. An improved model steam generator for simultaneously simulating one or more sets of thermohydraulic conditions inside of a full-scale steam generator in order to monitor the effect of these conditions on heat exchange tubes contained within the full-scale generator, comprising:

(a) a boiler vessel including a primary side, a tubesheet, and a secondary side fluidly connected to a source of water which is substantially identical to water which may be used in the full-scale generator, wherein the primary side includes a plurality of primary systems, each of which has its own individual and separately controllable heat source and each of which is separately pressure sealed so that the pressure differential between each primary system and the secondary side may be individually controlled;

(b) a plurality of sample heat exchange tubes of substantially the same material, diameter and wall thickness as the heat exchange tubes used in the full scale generator, wherein each of the tubes is thermally coupled to a separate one of said primary systems at one end through a separate, circulating flow of heated water generated by one of the primary systems, and to the secondary side of the boiler vessel at the other end, and (c) a heat flux control means connected to each of the heat sources of the primary systems for separately controlling the heat flux of each of the ends of the sample heat exchange tubes thermally coupled to said secondary side so that different sample tubes transfer heat at different fluxes.

17. An improved model steam generator in accordance with claim 16, wherein the heat source of each of the primary systems includes a high-intensity electrical resistance heater formed from a densely arranged configuration of electrical resistance wire to minimize the length of the primary side.

18. An improved model steam generator in accordance with claim 17, wherein each primary system includes an elongated chamber for holding a reservoir of water, a heat source for boiling this water, and a thermosyphon means for circulating the resulting vapor and condensate over the inside walls of the end of its sample tube which thermally communicates with the secondary side.

19. An improved model steam generator in accordance with claim 18, wherein the cross-sectional area of each of said elongated chambers is, on the average, no more than about four times the cross-sectional area of its respective sample tube in order to render the primary side of the boiler diametrically compact.

20. An improved model steam generator in accordance with claim 18, wherein the cross-sectional area of each of said elongated chambers is substantially the same as the cross-sectional area of its respective sample tube in order to render the primary side of the boiler diametrically compact.

21. An improved model steam generator in accordance with claim 16, wherein said tubesheet houses each of the primary systems of said primary side.

22. An improved model steam generator in accordance with claim 17, wherein each of the primary systems is fluidly connected to a charging system including only one charging pump for administering a water inventory into each primary system.

23. An improved model steam generator for simultaneously simulating one or more sets of thermohydraulic conditions inside of a full-scale steam generator in order to monitor the effect of these conditions on heat exchange tubes contained within the full-scale generator, comprising:

(a) a boiler vessel including a primary side, a tubesheet, and a secondary side fluidly connected to a source of water which may be used in the full-scale generator, wherein the primary side includes a plurality of primary systems, each of which has its own separately controllable heat source;

(b) a plurality of sample tubes for conducting heat from the heat sources of the primary side of the boiler to the secondary side, each of the tubes being thermally coupled to a separate one of said heat sources at one end, and to the secondary side of the boiler vessel at the other end, and wherein each of the primary systems and its respective sample tube is independently pressure sealed and (c) a control means connected to each of the heat sources of the primary systems for separately controlling both the heat flux of each of the ends of the sample heat exchange tubes thermally coupled to said secondary side, and the amount of pressure differential between each primary system and its respective tube and the secondary side.

24. An improved model steam generator in accordance with claim 23, further including means for separately sealing each of the primary systems with its respective sample tube.

25. An improved model steam generator in accordance with claim 23, wherein each of the primary systems includes a high-intensity electrical resistance heater formed from a coiled configuration of electrical resistance wire to minimize the length of the primary systems.

26. An improved model steam generator in accordance with claim 23, wherein said tubesheet houses each of the primary systems of said primary side in order to minimize the length of the boiler vessel.

27. An improved model steam generator in accordance with claim 23, wherein each primary system includes an elongated chamber for holding a reservoir or water, a heat source for boiling this water, and a thermosyphon means for circulating the resulting vapor and condensate over the inside walls of the end of its sample tube which thermally communicates with the secondary side.

28. An improved model steam generator in accordance with claim 27, wherein said tubesheet houses each of the primary systems of said primary side.

29. An improved model steam generator in accordance with claim 28, wherein each elongated chamber of the plurality of primary systems is formed from a bore in the tubesheet in order to minimize the length of the primary side.

30. An improved model steam generator in accordance with claim 27, wherein the cross-sectional area of each of said elongated chamber is, on the average, no more than about four times the cross-sectional area of its respective sample tube in order to render the primary side of the boiler diametrically compact.

31. An improved model steam generator in accordance with claim 29, wherein the cross-sectional area of each of said elongated chambers is substantially the same as the cross-sectional area of its respective sample tube in order to render the primary side of the boiler diametrically compact.

32. An improve model steam generator for simultaneously simulating one or more sets of thermohydraulic conditions inside of a full-scale steam generator in order to monitor the effect of these conditions on heat exchange tubes contained within the full-scale generator, comprising:

(a) a boiler vessel including a primary side, a tubesheet, and a secondary side fluidly connected to a source of water which is substantially identical to water which may be used in the full-scale generator, said primary side including a plurality of primary systems, each of which has its own separately controllable heat source, each of which is separately pressure sealed so that the pressure differential between each primary system and the secondary side may be individually controlled, and each of which is fluidly connected to a charging system including only one charging pump for administering a water inventory into each primary system, wherein the heat source of each of the primary systems includes a high-intensity electrical resistance heater formed from a densely arranged configuration of electrical resistance wire to minimize the length of the primary side;

(b) a plurality of sample heat exchange tubes of substantially the same material, diameter and wall thickness as the heat exchange tubes used in the full scale generator, wherein each of the tubes is thermally coupled to a separate one of said primary systems at one end, and to the secondary side of the boiler vessel at the other end, and (c) a heat flux control means connected to each of the heat sources of the primary systems for separately controlling the heat flux of each of the ends of the sample heat exchange tubes thermally coupled to said secondary side.

33. An improved model steam generator of the type including a primary side, a secondary side, a tubesheet, and a plurality of sample heat exchange tubes for conducting heat from the primary side through the tubesheet and into the secondary side by way of a circulation of heated water generated by the primary system which circulates along the inner walls of the sample tubes, comprising a primary side including a separate primary system for each sample tube, and a control means for separately controlling the heat flux of each of the sample heat exchange tubes in order to simultaneously simulate two or more different thermohydraulic conditions occurring in the heat exchange tubes of a full-scale steam generator.

34. The improved model steam generator of claim 33, wherein each of the separate primary systems is housed in separate bores in the tubesheet.

* * * * *